United States Patent [19]

Gardner et al.

[11] Patent Number: 4,554,218

[45] **Date of Patent: * Nov. 19, 1985**

[54] INFILTRATED POWERED METAL COMPOSITE ARTICLE

[75] Inventors: Richard N. Gardner, Grant Township, Washington County; Kenneth R. Dillon, White Bear Lake, both of Minn.

[73] Assignee: Minnesota Mining and Manufacturing Company, Saint Paul, Minn.

[ * ] Notice: The portion of the term of this patent subsequent to Apr. 27, 1999 has been disclaimed.

[21] Appl. No.: 611,924

[22] Filed: May 18, 1984

Related U.S. Application Data

[63] Continuation of Ser. No. 318,671, Nov. 5, 1981, abandoned.

[51] Int. Cl.[4] ..... B22F 3/00; B22F 1/00

[52] U.S. Cl. ..... 428/567; 428/569; 419/27; 419/23; 419/38; 419/37

[58] Field of Search ..... 428/546, 567, 569; 419/6, 8, 27, 38, 42, 37

[56] References Cited

U.S. PATENT DOCUMENTS

| | | | |
|---|---|---|---|
| 2,456,779 | 12/1948 | Goetzel | 416/241 R |
| 3,258,817 | 7/1966 | Smiley | 22/202 |
| 3,303,559 | 2/1967 | Holtzclaw | 15/248 |
| 3,397,968 | 8/1968 | Lavendal et al. | 428/566 |
| 3,423,203 | 1/1969 | Zdanuk et al. | 428/569 |
| 3,684,497 | 8/1972 | Wendler et al. | 428/567 |
| 3,779,715 | 12/1973 | Wendler et al. | 29/182.1 |
| 3,823,002 | 7/1974 | Kirby, Jr. et al. | 29/182.1 |
| 3,929,476 | 12/1975 | Kirby, Jr. et al. | 419/27 |
| 4,024,902 | 5/1977 | Baum | 164/97 |
| 4,123,265 | 10/1978 | Takahashi et al. | 428/569 |
| 4,140,170 | 2/1979 | Baum | 164/51 |
| 4,239,557 | 12/1980 | Thellmann et al. | 75/246 |
| 4,327,156 | 4/1982 | Dillon et al. | 428/568 |

FOREIGN PATENT DOCUMENTS 2005728A 4/1979 United Kingdom .

OTHER PUBLICATIONS

Sands & Shakespeare; *Powder Metallurgy;* 1966; pp. 118–119.

"Wetting of Ceramic Oxides by Molten Metals Under Ultra High Vacuum", F. L. Harding and D. R. Rossington, J. Am. Cer. Soc. 53, 2, 87–90 (1970).

"The Wetting of TaC by Liquid Cu and Liquid Ag", S. K. Rhee, J. Am. Cer. Soc. 55, 3, 157–159 (1972).

*Primary Examiner*—Edward A. Miller
*Assistant Examiner*—A. E. Brookes
*Attorney, Agent, or Firm*—Donald M. Sell; James A. Smith; David R. Cleveland

[57] ABSTRACT

A precision molded article, such as a die cavity, is made by combining granules of a first metal or alloy and a second metal or alloy, the second metal or alloy having a homogeneous appearance at some temperature below its melting point, and a higher Rockwell Hardness than the first metal or alloy, mixing the granules with a heat fugitive organic binder, molding the granule-binder mixture into a green molded preform, thermally degrading and removing essentially all the binder to form a skeletal preform, and infiltrating the preform with a third metal or alloy which will wet the second metal or alloy and has a lower Rockwell Hardness than the second metal or alloy, thereby forming a molded article having granules of first metal or alloy the majority of which are fully enveloped within a single skeleton of the second metal or alloy, the skeleton of second metal or alloy being surrounded by layers or matrices of softer metals.

34 Claims, 4 Drawing Figures

INFILTRATED POWERED METAL COMPOSITE ARTICLE

This is a continuation of application Ser. No. 318,671, filed Nov. 5, 1981, now abandoned.

TECHNICAL FIELD

This invention relates to powder metallurgy, metal composite materials, precision molded articles made from such materials, and a process for forming said articles.

BACKGROUND ART

Powder metallurgy techniques have been used to formulate metal composite materials with both high hardness and high impact strength. For example, U.S. Pat. Nos. 3,779,715, 4,024,902, and 4,140,170 describe composite articles containing metal carbide particles (e.g., tungsten carbide particles) surrounded by layers or matrices of softer metals. Such articles, though hard and impact resistant, are not readily machineable (as indicated by the disclosures of these patents). Also, the casting processes by which such articles are made are directed towards armorplate, large cutting tool bits, and the like, and are not well suited to the precision replication of parts such as die cavities.

U.S. Pat. No. 3,258,817 describes composite materials containing refractory particles surrounded by a binder metal. The refractory granules are said to be preferably interconnected in a continuous hard metal phase. Also, U.S. Pat. Nos. 3,823,002 and 3,929,476 describe precision shaped articles, such as electrical discharge machining electrodes, made by molding in a flexible mold a plastic mixture of multimodal refractory powders and a thermoplastic binder to form a green molded article of predetermined shape and dimensions, heating the green molded article to remove the binder and consolidate the refractory powders into an interconnected skeletal structure, and infiltrating the resulting skeletal structure with a molten infiltrant which is a low melting point metal or alloy. The articles of these three patents would not have high impact resistance, due to the interconnection or intergrowth of refractory granules. These articles would therefore be poorly suited for use as die cavities.

U.K. published Patent Application No. 2,005,728 A describes molded, non-refractory metal articles made by molding in a flexible mold a plastic mixture of non-refractory, spherical metal powders and heat-fugitive binder comprising thermoplastic material to form a green article of predetermined shape and dimensions, heating the green article to remove the binder and consolidate the non-refractory spherical powders in the form of a porous, monolithic skeleton of necked particles of non-refractory metal, infiltrating the skeleton with a molten metal having a melting point that is at least 25° C. less than the melting point of the lowest melting of the spherical, non-refractory particles, and cooling the metal infiltrated skeleton thereby forming a homogeneous, void-free non-refractory metal article of two intermeshed metal matrices. The molded skeleton may be made of particles of Fe, Co, Ni, or their alloys and the infiltrant metal may be Cu, Ag, or Sn. Such articles are well suited for use as die cavities. Commercial embodiments of such articles prepared from "Stellite 1" brand cobalt particles and 80/20 copper/tin infiltrant have a Rockwell C hardness of about 40 and a Charpy unnotched impact resistance of about 4.75 joules (3.5 ft. lbs.).

A need exists for a process and articles which provide precision molded articles (such as die cavities) with Rockwell hardness and impact resistance above that attained by the articles of U.K. Published Patent Application No. 2,005,728 A, while preserving or enhancing the fidelity of replication attained through the method described therein. Also, it would be desirable to obtain precision molded articles with improved Rockwell hardness and impact resistance which can be machined using conventional tional cutting tools. In addition, it would be desirable to provide precision molded articles using materials which have not previously offered sufficient dimensional stability when employed in the process of said U.K. Published Patent Application No. 2,005,728 A.

DISCLOSURE OF INVENTION

The present invention provides, in one aspect, a metal composite article, comprising:

(a) granules of a first metal or alloy of about 1 to 100 micrometers mean diameter;

(b) a monolithic skeleton comprising a solid second metal or alloy which has a homogeneous crystalline appearance at a temperature below its melting point when viewed under an optical microscope and has higher Rockwell hardness than said first metal or alloy, said second metal or alloy fully enveloping the majority of said granules of first metal or alloy, the latter being uniformly dispersed in said skeleton; and (c) a continuous metallic phase occupying the connected porosity in said skeleton, said continuous phase comprising a solid third metal or alloy which wets said skeleton, has a Rockwell hardness less than or equal to the Rockwell hardness of said second metal or alloy, and has a melting point below the melting point of said second metal or alloy;

said article thereby comprising two intermeshed matrices and being substantially free of voids.

BRIEF DESCRIPTION OF DRAWING

In the accompanying drawing.

DETAILED DESCRIPTION

Figure 1:
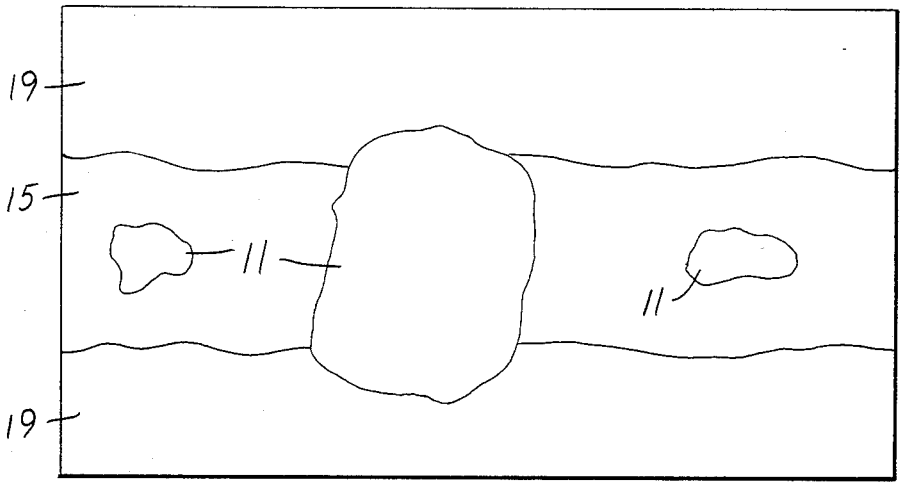
FIG. 1 is a schematic diagram (e.g., at 150×) of a microportion of one embodiment of an article of this invention.

In the practice of this invention, a replicating master of the desired shape and size is used to prepare a flexible rubber mold. Next, granules of said first metal or alloy (viz., component (a) above, hereafter referred to collectively as the "first metal") are mixed with granules of said second metal or alloy (viz., that of skeleton (b) above, hereafter referred to collectively as the "second metal"). The resulting powder mixture is mixed with a heat fugitive binder and the powder-binder mixture is then placed in said mold and thereby molded into a shape that is the same as the desired final shape. The powder-binder mixture is cured in the flexible mold and the resulting cured, molded "green" article is demolded and heated to thermally degrade and remove essentially all of the binder. The resulting porous molded shape or "preform" is then infiltrated at a temperature below the melting point of the first and second metals with said third metal or alloy (hereafter sometimes referred to as the "infiltrant"). After infiltration, the infiltrated article is optionally heat treated to improve its physical properties.

During the infiltration step, contiguous granules of the first metal and the second metal undergo sintering by volume diffusion, whereby the second metal granules lose their original particle shape and merge or consolidate to form a monolithic skeletal structure which fully envelopes or surrounds the majority of the granules of first metal. The second metal granules thereby undergo extensive change in their original shape. The elements of the skeleton are in turn surrounded by the infiltrant. After cooling the final article, the infiltrated skeleton corresponds in shape to that of the replicating master. In this skeleton, the connected porosity (i.e., void space which is not sealed off or isolated from porosity which communicates with the exterior of the skeleton, in contrast to "closed porosity" which is inacessible void space wholly within the body of the skeleton) is occupied by the infiltrant. The infiltrated, molded article contains dispersed (i.e., not interconnected) granules of first metal, each of which is surrounded by a layer of material having higher hardness and lower impact strength than the first metal, which material is in turn intermeshed with a material having lower hardness and higher impact strength than the second metal. The article as a whole exhibits high hardness, high impact strength, and ready machinability, and is a faithful replica of the master used to prepare the mold from which the molded preform was made.

The volume diffusion phenomenon mentioned above is a solid state reaction which occurs below the melting point of the second metal. The manner in which this reaction occurs can be described as "particle encirclement by diffusional transport means". Despite the extensive change in shape of the granules of second metal which occurs, and the consolidation of the granules of second metal into a monolithic skeleton, the finished composite articles of the present invention exhibit surprisingly little change in shape or size.

The microstructure of a molded article of the present invention can be further understood by reference to FIG. 1. Referring to FIG. 1, shown in schematic view are granules of first metal 11. The majority of these granules of first metal are fully enveloped by second metal 15. Second metal 15 is in turn intermeshed with or surrounded by infiltrant 19 (the third metal). The majority of the granules of first metal 11 are not in contact with infiltrant 19.

When a representative metallurgically-prepared cross-section of an article of this invention is examined with a light microscope at a magnification at which said two matrices are discernible, e.g., 150×, the granules of first metal are essentially uniformly distributed throughout the skeleton formed by the second metal, and the second metal and infiltrant are essentially uniformly distributed throughout the article. Of course, at much higher magnifications, the granules of first metal, the second metal, and infiltrant may no longer appear to be uniformly distributed within the field of view. There is no unique axis or densification of the granules of first metal in any portion of the skeleton (especially in the peripheral portion, i.e., the portion adjacent the surface of the article), such as that otherwise indicative of the use of pressure to shape the final article. The molded articles of the present invention are essentially free of interior and surface defects, such as voids or pits, and exhibit physical, chemical, electrical, and mechanical properties which are uniform from article to article.

The uniform properties from article to article and precision tolerance of the articles of this invention means that these articles are particularly well-suited for applications where high hardness, wear and impact resistance, and close dimensional tolerances are desirable, such as articles with intricate or complex shapes and surfaces with fine details, e.g., stamping and injection molding die cavities which are used to make metal or plastic parts whose shape corresponds to the shape of the die. Articles prepared according to the present invention can exhibit Rockwell hardness greater than about 40 together with Charpy unnotched impact strengths greater than about 14 joules (10 ft.-lbs.).

The replicating master used to prepare molded articles according to the present invention can be made in a conventional manner from wood, plastic, metal, or other machinable or formable material. If a molded article prepared according to the process of the present invention exhibits dimensional change (e.g., shrinkage), then the dimensions of the replicating master can, in some cases, be adjusted (e.g., made larger) to compensate for those dimensional changes occurring during processing. Such adjustment may be desirable in the manufacture of large articles of this invention, such as articles with a volume of 1 liter or more.

The metal articles produced in the practice of this invention can have a working surface (that is, a working portion) that comes into contact with and effectuates a deformation in a material to be worked, and a support portion that maintains the working surface in the proper position to produce the desired deformation. For example, a core pin, produced according to this invention, can be used to form a hole in an injection molded plastic part. The working surface of such a core pin is that portion that actually comes into contact with the plastic material to be molded, and the support portion holds the core pin in position so that the desired hole is produced.

The preferred master has the working surface and support portion mounted on and extending out of or away from a base. The base may be the remainder of the material from which the working surface-support portion was produced, or the working surface-support portion may be mounted on a separate base after production. If the preferred master is used, then in the later light sintering step a one-piece porous metal skeleton will be produced having a working surface-support portion mounted on a base. After infiltration, the base may be completely removed or machined to a desired configuration to be used as the support portion for the working surface. In this latter instance, the base functions as both the support portion and base and therefore the working surface may be mounted directly on the base.

The molding materials which can be used to prepare a flexible mold in the process of this invention are those which cure to an elastic or flexible rubbery form and generally have a Shore A durometer value of about 25–60, and reproduce the fine details of the replicating master without significant dimensional change, e.g., without more than 0.5 percent linear change from the replicating master, and preferably with essentially zero linear change. The molding materials should not be degraded when heated to molding temperatures, e.g., 180° C., and desirably should have a low cure temperature, e.g., room temperature. A low temperature curing molding material will form a mold which maintains close dimensional control from master to mold, while a high temperature curing molding material will generally produce a mold having dimensions which differ undesirably from those of the master. To maintain dimensional control, it is preferable that the mold material have a low sensitivity to moisture. Examples of suitable molding materials are curable silicone rubbers, such as those described in Bulletin "RTV" 08-347 of January, 1969, of the Dow Corning Co., and low exotherm urethane resins. Such molding materials cure to an elastic or rubbery form having a low post cure shrinkage. The molding material can be optionally reinforced by the addition of about 30 volume percent of less than 44 micrometer diameter glass beads which may improve dimensional control in the molding process, particularly in the molding of parts having a volume greater than about 450 $cm^3$.

The amount of molding material used to form a mold of the replicating master can vary depending on the particular molding material used and the shape of the replicating master. It has been found that about 10 to 14 $cm^3$ of molding material for each cubic centimeter of the replicating master will form a mold which retains the desired flexible properties and also has sufficient strength to resist the small hydrostatic head produced by the warm powder-binder mixture in the mold before solidification of the binder.

The molding conditions for molding the articles of this invention permit the use of an inexpensive, soft, elastic or rubbery mold because the only pressure applied is the hydrostatic head of the warm metal powder-binder mixture in the mold, which pressure is much less than that used in conventional powder metallurgy compaction. The mild molding conditions thus help ensure a precisely molded green article even though a deformable mold is used. In addition, the molding technique results in a molded green article with a uniform density.

The granules of first metal are preferably present in the final molded, infiltrated article in amounts less than about 15 volume percent, and, for spherical particles, are present in amounts greater than about 4 volume percent. For non-spherical particles, the minimum amount will usually be less than 4 volume percent, but cannot be stated with precision, as the minimum amount depends, inter alia, upon the surface area of the granules of first metal. The minimum volume percent of first metal also depends upon the shear modulus of the second metal, the radii of the first and second metal particles, and the desired ultimate strength of the final composite article. The granules of first metal are most preferably present in amounts between about 8 and 13 volume percent. The granules of first metal used to make the final molded article can be regularly or irregularly shaped particles having an original mean diameter of about 1 to about 100 micrometers and preferably about 1 to about 44 micrometers (as determined by Coulter Counter).

Suitable first metals useful in this invention include elemental metals such as W, Mo, Ta, Nb, V, and Ti. The chosen first metal should have a sufficiently limited solubility in the second metal so that the granules of first metal do not completely dissolve in the second metal during processing of the composite article. Also, the first metal should desirably be sufficiently stable to withstand the processing conditions and temperatures at which infiltration is carried out without undergoing decomposition. This processing consideration can be satisfied by examining equilibrium solubility and rate of solubilization data for a given first metal second metal combination, or by empirically infiltrating, sectioning and examining one or more test composite articles and noting the change in first metal granule size which takes place during infiltration. Tungsten is the preferred first metal in a composite article in which the second metal is ferroalloy.

The second metal is solid and must be homogeneous at a temperature below its melting point. By "solid" is meant that the second metal in the final article is a solid at room temperature. By "homogeneous" is meant that at some temperature below the temperature at which the second metal liquifies, the second metal must form a crystalline solid solution which has a homogenous crystalline appearance when viewed under an optical microscope. The second metal need not be homogeneous at room temperature and need not be homogeneous at all temperatures below its melting point. It merely must be homogeneous at some temperature below its melting point without phase separation. The second metal must also have a Rockwell hardness greater than the Rockwell hardness of the first metal as measured under similar test conditions using ASTM E-103-61 (Reapproved 1979). Also, the second metal must be capable of undergoing volume diffusion at some temperature below its melting point when in admixture with the first metal granules and the liquefied infiltrant. By "volume diffusion" is meant a solid-state sintering reaction occurring during heating of contiguous metal particles. Volume diffusion (sometimes referred to as "lattice diffusion") is characterized by the spontaneous movement of atoms or molecules from the interior of contiguous metal particles to the previously unoccupied space between contiguous metal particles. Volume diffusion can be recognized by the occurrence of "necking" between contiguous metal particles (i.e., formation of an enlarged contact area with a concave edge profile) and by a concurrent change in the shape of the remaining (unnecked) outer surface of contiguous metal particles. Volume diffusion may be contrasted with a different solid-state sintering reaction referred to as "surface diffusion". Surface diffusion is characterized by the spontaneous movement of atoms or molecules from the surface of contiguous metal particles to the previously unoccupied space between contiguous metal particles. Surface diffusion can be recognized by the occurrence of necking without a concurrent change in the shape of the remaining (unnecked) outer surface of contiguous metal particles. The necking and particle shape change phenomena referred to above are generally detected by sectioning and polishing a sintered, cooled powdered metal composite and examining the polished surface under optical magnification.

The processing conditions necessary to promote volume diffusion in an article of this invention may tend to vary as the shape or volume of that article is altered. Volume diffusion is both time and temperature dependent, and is more likely to take place as the time and/or temperature at which infiltration is carried out is increased. Infiltration can, if desired, be carried out above the minimum temperature at which volume diffusion occurs, but should not be carried out above the melting point of the first metal.

The second metal is present in the final shaped, infiltrated article in amounts between about 35 and about 78 volume percent, preferably in amounts between about 57 and about 62 volume percent. The granules of second metal used to make the final molded article can be regularly or irregularly shaped particles having an original mean diameter of about 1 to about 100 micrometers, preferably about 1 to about 44 micrometers. Suitable second metals include powdered ferroalloys and other metals which satisfy the above homogenity, Rockwell hardness, and volume diffusion criteria, such as "1018" (see AISI type 1018) low carbon steel, molybdenum, nickel, manganese, and, under proper furnacing atmospheres such as dry, pure hydrogen gas, cobalt. Copper can be used as the second metal if a lower melting metal or alloy (such as some copper alloys) is used as the infiltrant. A powdered ferroalloy known as "$A_6$" tool steel (see AISI type $A_6$) having a typical composition 94.7% Fe, 2.25% Mn, 1.35% Mo, 1.0% Cr, 0.7% C, and 0.3% Si is most preferred.

Organic binders suitable for use in this invention are those which melt or soften at low temperatures, e.g. less than 180° C., preferably less than 120° C., thereby providing the metal powder-binder mixture with good flow properties when warmed and yet allowing the metal powder-binder mixture to be solid at room temperature so that a green article molded therefrom can be normally easily handled without collapse or deformation. The binders used in this invention are those which are heat fugitive, that is, which burn off or volatilize when the green molded preform is heated. Preferred heat fugitive binders degrade without causing internal pressures on the resulting skeletal preform (which promote internal fractures) and without leaving substantial binder residue in the skeletal preform. Preferably, during heating of the molded mixture of first and second metal granules, the chosen binder gradually degrades or decomposes at a low temperature and leaves a minimal carbonaceous residue.

Organic thermoplastics or mixtures of organic thermoplastics and organic thermosets are used as binders. Thermoplastic materials generally leave lower carbonaceous residues than thermoset materials when thermally degraded. Thermoplastic-thermoset binder mixtures tend to produce green articles that have higher green strength and thus are more handleable than green articles made with just a thermoplastic as the binder. Also, thermoplastic-thermoset binder mixtures can be processed without obtaining solidification shrinkage, while the use of a thermoplastic binder such as "Emerest" 2642 alone generally leads to minor lineal solidification shrinkage. Thermoplastic-thermoset binder mixtures are preferably cured by heating the warmed, vibrated mixture of powders in the mold.

The use of a mixture of thermoplastic and thermoset binder is particularly advantageous when large composite articles are prepared, such as articles in which some of the binder degradation products must escape from the internal portion of the article through a distance greater than about 2 cm. Preferably the thermoplastic binder in such thermoplastic-thermoset binder mixtures is a low molecular weight thermoplastic material or mixture of such materials, thereby enabling stepwise degradation of the binder components and orderly removal of the binder from the green molded article during heating thereof, without causing internal fractures in the molded article. Such a step-wise burn-off is carried out by heating the green molded article to two or more successive temperatures, those temperatures being the individual decomposition temperatures of the thermoplastic and thermoset portions of the binders. Alternatively, the thermoplastic portion of the binder may be substantially removed by solvent leaching followed by thermal degradation of the thermoset portion of the binder.

A further alternative binder system employs one or more diluents with the binder. The diluents volatilize prior to any significant binder degradation and thus provide open passages for the thermal degradation products during burn-off, reducing or eliminating internal fractures in the molded article. The diluent(s) should be liquid(s) which are good solvents for the uncured binder but poor solvents for the cured binder. The diluent(s) should be minimally absorbed by the flexible molding material. Also, the diluent(s) should have sufficiently high boiling points so that they do not boil away before curing or setting of the binder, and sufficiently low boiling points so that they volatilize before the binder begins to thermally degrade.

As the ratio of binder resin to the total amount of thermoplastic plus diluent decreases, binder flow increases, metal powder loading increases, deairing of the binder-metal powder mixture becomes easier, and there is less tendency for the molded part to crack or blister during binder degradation. However, as such ratio decreases, green part rigidity and green-state dimensional stability generally decreases.

Representative thermoplastic binders which can be used include paraffin, e.g., "Gulf Wax" (household grade refined paraffin), a combination of paraffin with a low molecular weight polyethylene, mixtures containing oleic or stearic acids or lower alkyl esters thereof, e.g., "Emerest" 2642 (polyethylene glycol distearate, average molecular weight of 400) or "Carbowax" 200 (polyoxethylene glycol, average molecular weight of 200), as well as other waxy and paraffinic substances having the softening and flow characteristics of paraffin. "Emerest" 2642 is a preferred thermoplastic binder because it is absorbed by a flexible silicone rubber mold to a lesser degree than many other thermoplastics. "Carbowax" 200 is a preferred thermoplastic binder for use in thermoplastic-thermoset binder mixtures.

Representative thermosetting binders which can be used in combination with thermoplastics include epoxide resins, e.g. diglycidyl ethers of bisphenol A such as 2,2-bis[p-(2,3-epoxypropoxy)phenyl] propane, which can be used with appropriate curing catalysts. Care must be exercised so as not to thermally induce cross-linking during the mixing and molding steps when thermosetting binders are used.

Representative solvents which can be used for leaching out the thermoplastic portion of a thermoplastic and thermoset binder mixture are ketones such as acetone or methyl ethyl ketone, and aqueous solvents.

Representative diluents which can be used are those which volatilize at temperatures of about 150° C. to 210° C., such as low molecular weight polyoxyglycols and light hydrocarbon oils. A preferred diluent is 1,3-butanediol (b.p. 204° C.).

A particularly useful thermoplastic-thermoset binder mixture can be made from 29.6 parts "Epon" 825 bisphenol-A epoxy resin, 9.1 parts "Epi-cure" 872 polyamine curing agent, 29.25 parts of "Carbowax" 200 polyethylene glycol, and 35.75 parts 1,3-butanediol. This binder should be heated to about 40° C. in order to provide adequate flow of the binder-metal powder mixture during filling of the mold. The amounts of components given above may have to be empirically adjusted to optimize production of a given part shape or size.

The infiltrant (i.e., the third metal) in the final shaped article has a melting temperature below the melting temperature of the second metal. Also, the infiltrant is a solid in the final article at room temperature. The infiltrant must also "wet" the skeleton. Such wetting can occur either because the infiltrant wets the second metal or because the principal metal component within the infiltrant (or an alloying ingredient within the infiltrant) reacts to form an alloy with the second metal, which alloy coats the second metal and is wet by the infiltrant. Wetting of the skeleton by the infiltrant can be determined empirically (by testing to see if infiltration occurs) or by determining if the infiltrant will wet the second metal according to the sessile drop test. Wettable combinations of infiltrant and second metal will have a sessile drop test wetting angle of 90° or less under a hydrogen atmosphere. The sessile drop test is described, for example, in "Wetting of Ceramic Oxides by Molten Metals under Ultra High Vacuum", F. L. Harding and D. R. Rossington, J. Am. Cer. Soc. 53, 2, 87–90 (1970) and in "The Wetting of TaC by Liquid Cu and Liquid Ag", S. K. Rhee, J. Am. Cer. Soc. 55, 3, 157–159 (1972). The empirical test is the most reliable indication that the infiltrant will wet the skeleton, because the wetting of the skeleton which occurs may be due to the above-described formation of intermediate alloys of second metal with infiltrant (or an alloying ingredient present in the infiltrant). Formation of such wettable alloys may be difficult to predict in advance. However, the sessile drop test is generally reliable and serves as a useful guide in predicting whether or not the infiltrant will wet the skeleton.

Also, the infiltrant has a Rockwell hardness less than or equal to the Rockwell hardness of the second metal, measured under similar testing conditions according to the above ASTM test. Satisfaction of the above hardness condition and satisfaction of the second metal hardness condition mentioned earlier requires that in an article of this invention, the second metal has the highest hardness in the composite article. Because hardness and impact strength are generally inversely related, the infiltrant has an impact strength which is higher than the impact strength of the second metal, measured according to ASTM E-23-72 (Reapproved 1978).

Preferably, the second metal and infiltrant are not substantially soluble in one another, although this is not required for the practice of the present invention.

The infiltrant preferably occupies about 15 to about 50 volume percent, and most preferably 25 to about 35 volume percent of the final molded, infiltrated article. The infiltrant can be used in any convenient form (e.g., granules, sheets, foil, or beads) as it is melted during infiltration of the skeleton. Suitable infiltrants include copper, copper alloys (e.g., copper-manganese alloys), silver, silver alloys, tin, tin alloys, iron, and multicomponent alloys such as ferroalloys. Copper and copper alloys are preferred infiltrants, especially when ferroalloy powders are used as the second metal. In addition, when ferroalloy powders are used as the second metal, then copper-manganese alloys containing about 4 to about 35 weight percent manganese are a preferred infiltrant. The presence of manganese in the infiltrant results in the formation of an intermediate layer of austenitic iron at the interface between the second metal and infiltrant. Other alloying ingredients can be added to the infiltrant to enhance the properties of the final molded article. For example, in an article of this invention containing ferroalloy second metal and copper alloy infiltrant, the presence of boron, magnesium, indium, or silver as alloying ingredients in the infiltrant will enhance the fluidity of the molten infiltrant. The presence of nickel and tin as alloying ingredients in the infiltrant will enhance the toughness of the final article through promotion of spinodal decomposition as the infiltrant cools. The presence of iron as an alloying ingredient in the infiltrant will decrease the corrosive action of the infiltrant upon a ferroalloy skeleton and thereby improve the dimensional stability of the final article. Silicon, when present as an alloying ingredient in the infiltrant will act as a deoxidizer for other alloying ingredients of the infiltrant.

The articles of this invention can contain other materials (e.g., dissolved gases) if such materials are desired in order to alter the physical properties of the final article. However, the presence of such materials is not required in this invention, and the articles of the invention can consist essentially of or consist of first metal, second metal, and infiltrant.

When a skeletal preform containing the above-described granules of first metal and powdered second metal is placed adjacent the above-described infiltrant and heated above the melting point of the infiltrant, the infiltrant will melt and "wick" into the interior of the preform. Additional heating (to the temperature at which the second metal undergoes volume diffusion) results in substantial rearrangement of components within the composite by solid state reactions involving first metal, second metal and molten infiltrant. Granules of the second metal undergo volume diffusion, merging with one another and enveloping individual granules of the first metal. The second metal assumes the form of a continuous skeleton within which are enveloped the granules of first metal. The infiltrant fills the connected porosity of the skeleton, and is in contact with the second metal but no longer in contact with the granules of first metal (which have become enveloped in the second metal). On cooling, the rearranged composite structure is preserved, thereby locking-in or retaining the spaced position of the encircled granules of first metal and preserving the original dimensions of the master. Optionally, at the interface between granules of first metal and the second metal, crystalline compositions of first metal and second metal can form into one or more intermediate concentric shells or zones surrounding an individual granule of first metal. In addition, if the infiltrant contains a component which will react with or alloy with the second metal (e.g., when manganese is present in the infiltrant and the second metal contains iron), then, at the interface between the second metal and infiltrant, additional crystalline compositions of second metal and the reactive or alloying infiltrant component can optionally form into one or more intermediate shells or zones adjacent the second metal and bulk of the infiltrant.

Examination of a polished metallurgical section of a finished composite article of this invention under optical magnification shows that the granules of first metal retain their original particle shape and spacing. The particles of second metal lose their original particle shape and become a continuous skeletal structure. The finished composite article exhibits relatively little dimensional change when compared to the master from which the preform was molded. Dimensional change of a shaped article of this invention prepared from tungsten, $A_6$ tool steel, and copper according to the present invention is generally less than about 1 percent in any lineal dimension, and frequently less than about 0.5 percent. This low degree of dimensional change is surprising in view of the extensive dimensional change, occuring as shrinkage of greater than about 2 percent, which occurs when a composite is prepared from $A_6$ tool steel infiltrated with copper.

Shrinkage in the articles of this invention is minimized in spite of the large amount of volume diffusion occuring during infiltration. Volume diffusion is one mechanism by which sintering is carried out in the art of powder metallurgy. Other known sintering mechanisms include viscous or plastic flow, evaporation and condensation, and surface diffusion. All of these sintering mechanisms generally promote shrinkage in the sintered article. Sintering in the articles of this invention appears to occur by a uniquely different mechanism than that which is generally known to occur in powder compacts or "green" parts. The formation of a "gradient microstructure" occurs, as a particle encirclement by diffusional transport which takes place during infiltration under solid state conditions, i.e., well below the melting point of the second metal. By "gradient microstructure" is meant a heterogeneous crystalline structure containing a plurality of contiguous crystalline regions, each in the form of a shell or plurality of contiguous shells surrounding, encircling, or enveloping a granule of first metal, the shells exhibiting a progressive, gradual change with respect to physical properties, such as Rockwell hardness and impact strength, as measured radially outward from any individual granule of first metal. The presence of granules of first metal which are greater than 1 micrometer in size and the selection of second metal is critical to maintaining dimensional stability in the final article. As encirclement of granules of first metal by the second metal proceeds, a very slight amount of shrinkage results. However, shrinkage does not become excessive because a band of second metal forms a continuous path between granules of first metal. The skeletal structure formed by the second metal is insensitive to the erosive and corrosive action of the infiltrant, and the spacing between individual granules of first metal remains constant, because part of the narrow band or link of second metal between granules of first metal is not in contact with the infiltrant and does not undergo further diffusion.

Figure 2A:
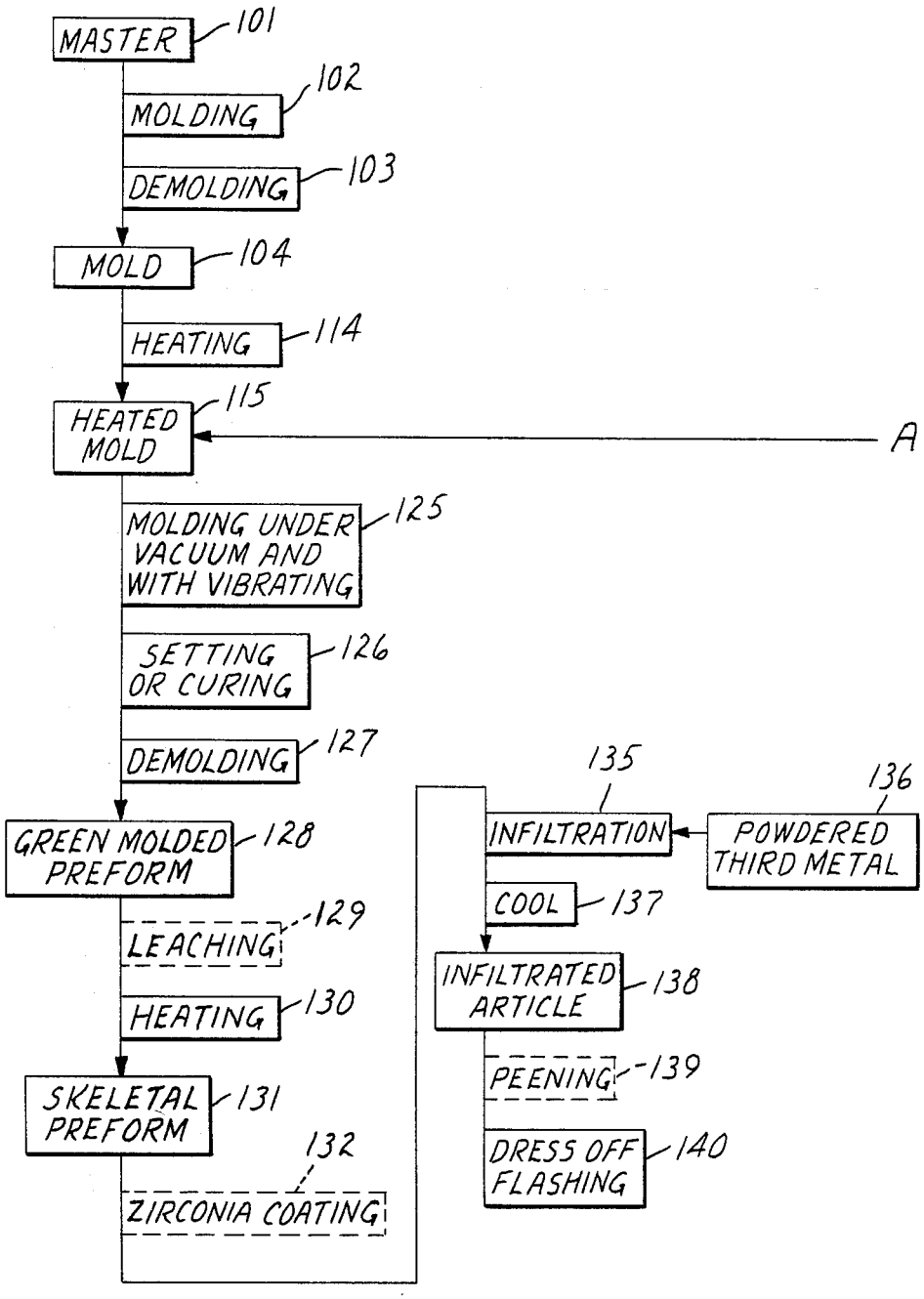
FIGS. 2A and 2B are a flow diagram showing preferred steps in the manufacture of precision shaped articles of this invention.
Figure 2B:
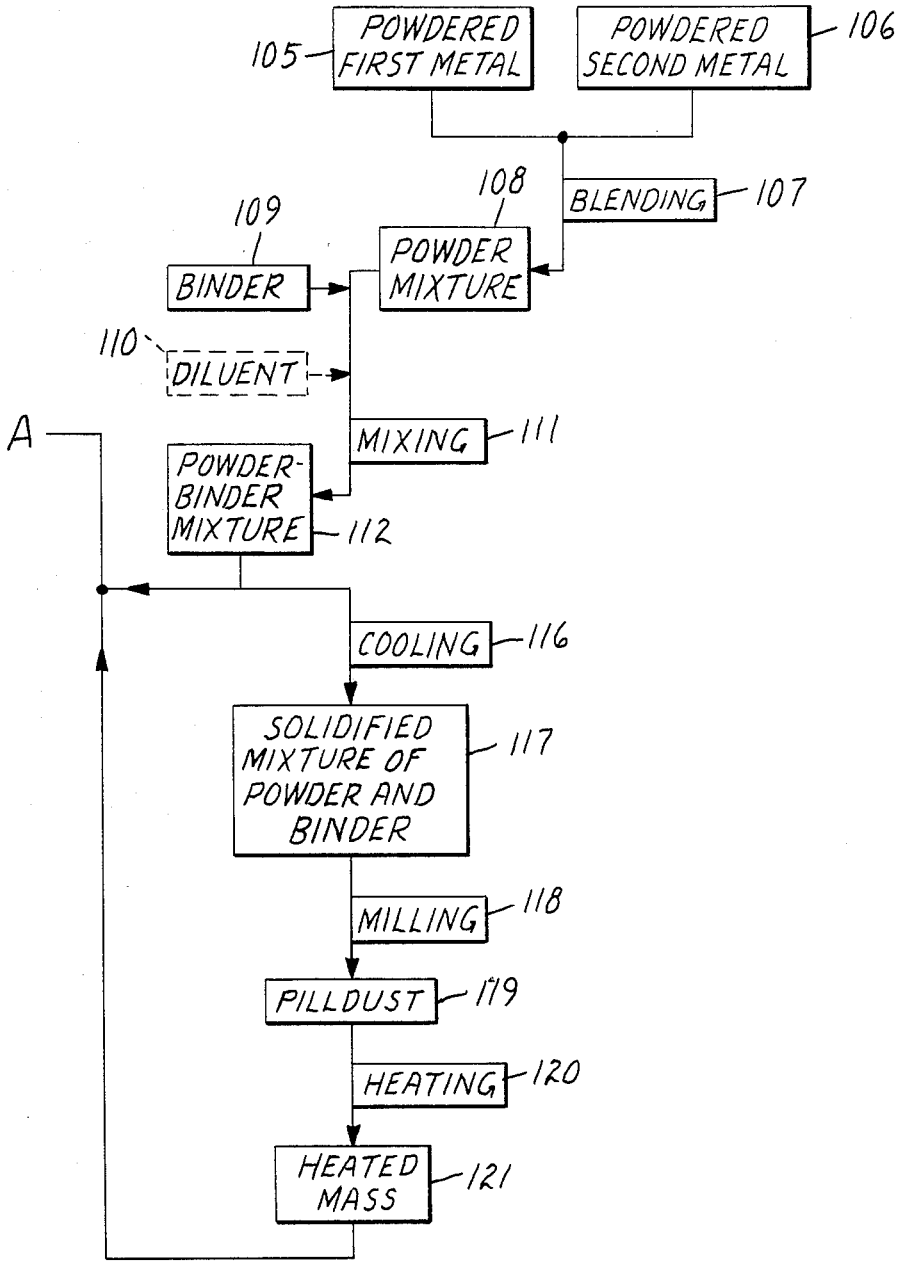

Referring to FIGS. 2A and 2B, which illustrate a preferred method for forming articles of this invention, a replicating master 101 is used to mold 102 a flexible form in the desired shape by surrounding the master with an elastic, rubbery, molding compound, and demolding 103 the master from the cured solid rubbery mold 104. An admixture of powdered first metal 105 and powdered second metal 106 is blended 107 to form a powder mixture 108 which is next combined with a heat fugitive thermoplastic or thermoplastic and thermosetting binder 109 and any optional diluents 110 by mixing 111 (without causing premature cure of the binder if a thermosetting binder is used) in a blending device, e.g., a sigma blade mixer, resulting in formation of a powder-binder mixture 112. The powdered first metal and powdered second metal mixture is uniformly dispersed in the binder matrix conducive to forming a preform with homogeneous (i.e., uniform) density which will be essentially uniformly porous when the binder is thermally degraded. The powder-binder mixture is preferably warmed 10° C. to 20° C. or more above the softening point of the thermoplastic binder component.

The flexible mold 104 is heated 114 and the powder-binder mixture 112 fed directly to the heated mold 115. Optionally, instead of immediately molding the powder-binder mixture, a mixture made with a thermoplastic binder can be cooled 116 to a solidified mass 117 and milled 118, preferably in a vacuum, to a granular or free-flowing consistency ("pill dust" 119) for easy handling and storage, and subsequently heated 120 to a heated mass 121 at the time of the molding step. The heated mold and its contents (the powder-binder mixture 112 or heated mass 121) are vibrated under vacuum 125 in order to degas the mixture. By choosing the proper size distribution of metal particles and a suitable organic binder, the consistency of the powder-binder mixture is such that the mixture can be molded with only slight vibration to ensure removal of air pockets or gas bubbles.

After filling the warmed, evacuated mold, vibration of the mold is discontinued and the mold is isothermed, e.g., maintained at a constant temperature 10° C. to 30° C. above the softening point of the binder (for a thermoplastic binder) or maintained at the thermal cure temperature (for a binder containing thermoset resin), for about 1 to 24 hours. The mold and its contents are vibrated for a short period during such isotherm to bring the mold and the green molded part into dimensional conformity.

If the binder is a thermoplastic which melts at a fairly low temperature, e.g., 35° C. to 40° C., then it is necessary to cool the mold and its contents to the point where the binder sets 126 and becomes fairly rigid (e.g., to 0° C. to 5° C.) to demold the green molded part, preferably in a desiccator to reduce moisture condensation. If the binder contains thermoset resin, then such cooling is not required, as the binder will cure 126 and the green molded part can be demolded at the isotherm temperature. The solid green article can be easily demolded 127 by application of a vacuum to the exterior of the flexble mold. Vacuum demolding allows easy demolding of shapes that have undercuts. After demolding, the resultant "green" molded preform 128 is a faithful replica of the dimensions of the master. This molded shape has good green strength and uniform density due to the hardened matrix of binder which holds the powdered first and second metals together.

If a mixture of thermoplastic and thermoset binders was used to make the green molded preform, then the thermoplastic binder can be partially removed from the green molded preform by optionally leaching 129 the preform in a solvent such as methylethylketone or water for a period of about 4 to about 12 hours or less.

The green molded preform 128 is packed in a non-reactive refractory powder, e.g., alumina or silica, to prevent sagging or loss of dimension, and subsequently heated 130 in a furnace to a temperature of about 780° C. or more to thermally degrade the binder. If mixtures of thermoplastic and thermoset binders are used, or if diluted binders are used, the heating step is carried out in a series of stages in order to first remove those materials which boil off or degrade at low temperatures, followed by removal of the remainder of the binder. During the heating step, the bulk of the binder is removed from the article by vaporization and as gaseous products of degradation, leaving a minute amount of amorphous carbonaceous residue which may help to tack the powdered first and second metals together. A heating schedule found suitable for articles as large as 125 $cm^3$ when, for example, polyethylene glycol distearate is used for the organic binder, is as follows:

Step 1: from room temperature to 200° C. (about 43° C. per hour)

Step 2: from 250° C. to 400° C. (about 7.5° C. per hour)

Step 3: from 400° C. to the light sintering temperature (about 100° C. per hour).

This programmed heating is carried out under a protective atmosphere, e.g., hydrogen-argon, hydrogen, argon, or other neutral or reducing atmospheres known in the powder metallurgy art to prevent oxidation of the metal particles.

Heating the green molded article to a temperature in excess of about 1050° C. when alumina is used as the refractory non-reactive support material may cause some alumina to adhere to the green molded article. For this reason, when a final light sinter temperature in excess of about 1050° C. is intended, the light sintering process may be stopped at about 1050° C. and the resulting coherent, handleable molded article can be cooled and removed from the alumina bed. Alumina adhering to the surface of the article is gently removed and the article heated to the desired final light sintering temperature without supporting the article in non-reactive refractory powder. Where light sintering temperatures of less than about 1050° C. are employed, surface adhering support material can be removed by gentle brushing with a camel's hair brush.

After sintering of the green molded article, the powdered first and second metals and carbonaceous residue form a rigid, handleable, metallurgically integral, porous, monolithic skeletal preform 131. The term "metallurgically integral" as used herein means that there is solid state interatomic diffusion, i.e., there is a solid state bond formed between the various metal particles of the skeleton. The particles of powdered first and second metals essentially retain their original particle shapes and relative positions when viewed under optical magnification.

A skeletal preform made by the above heat fugitive binder method will have minimal closed porosity. The major portion of the void space in such a preform will represent connected porosity. Only connected porosity can be filled by molten infiltrant.

The preform is next infiltrated with the infiltrant. If desired, infiltration can be carried out immediately after thermal degradation of the binder and without cooling of the skeletal preform.

The surfaces of the skeletal preform which will be coincident with the working surfaces of the final infiltrated article are preferably coated 132 with a dispersion of zirconia in acetone in order to eliminate overwetting, i.e., "beading" or "blooming" of infiltrant at those surfaces of the skeletal preform. The infiltration step 135 is preferably carried out by supporting the skeletal preform 131 and infiltrant (third metal) 136 in or on a bed of alumina in a crucible, for example, one made of graphite, alumina, or mullite. The infiltrant (in solidified form) is placed either in contact with the base of the skeletal preform or not in such contact but flowable under the influence of gravity toward that area of the metal skeleton through which infiltration is to occur.

The preform and infiltrant are heated above the melting point of the infiltrant to a temperature at or above the temperature at which the second metal undergoes volume diffusion, but to a temperature below the melting point of the second metal. Infiltration (and the attendant volume diffusion of the second metal and encirclement of the majority of the granules of first metal by the second metal) is preferably carried out at the lowest temperature at which volume diffusion is observed to occur. The amount of infiltrant is usually chosen to be slightly in excess of the amount necessary to fill the connected porosity of the skeletal preform (as determined by calculation or empirically). When the melting point of the infiltrant has been reached, the infiltrant will melt and "wick" into the interior (the connected porosity) of the skeletal preform by capillary action. Heating is continued until the temperature at which the second metal undergoes volume diffusion is reached (this temperature may be the same as the melting point of the infiltrant or a higher temperature). The infiltrated preform is then cooled 137, the infiltrated article 138 extracted, and any excess zirconia coating is removed, e.g., by peening 139 with a glass bead peening apparatus (e.g., Empire Abrasive Equipment Corp. Model No. S-20) at a pressure of 1.4 to 2.8 $kg/cm^2$ using an 8 mm diameter orifice. If an age hardenable infiltrant is employed, e.g., copper alloyed with nickel (15%) and tin (7%), or if the metal skeleton is hardenable, the infiltrated article may be subjected to a temperature aging cycle, using techniques well known in the art of metalworking, to change the grain structure of the interior or surface of the composite and increase the hardness and/or wear resistance of the infiltrated article. Finally, excess flashing is dressed off 140 and any superfluous base material is machined or cut away from the shaped working surface to produce the finished infiltrated molded article.

The time and temperature necessary to infiltrate the preform and ensure that volume diffusion of the second metal occurs will vary depending upon the choice of second metal, the rate of heating, the gross dimensions of the preform being infiltrated, the wetting characteristics of the infiltrant-skeleton combination, and the diameter of the pore-like passages within the skeleton. These times and temperatures are determined empirically using microscopic analysis of the infiltrated sample. An infiltrated article which has been insufficiently heated will not undergo volume diffusion. Microscopic analysis of such an article will reveal that the particles of powdered second metal have not lost their original shapes and have not enveloped the first metal. An infiltrated article which has been excessively heated may undergo liquid phase reactions of the second metal due to melting of the second metal. Microscopic analysis of such an excessively heated article will reveal that the granules of first metal have been greatly reduced in size due to reaction with the second metal. In addition, an excessively heated article may be characterized by severe distortion or dimensional change relative to the desired master shape.

The resulting infiltrated molded article, such as a copper infiltrated article, is substantially void-free (i.e., it has a density at least 97% and usually 99% or more of the theoretical density based upon the densities of the constituents of the preform and of the infiltrant phase). Essentially the only uninfiltrated space in such an infiltrated article is the closed porosity of the original preform. The connected porosity of the original preform is essentially completely occupied by the infiltrant.

Figure 3:
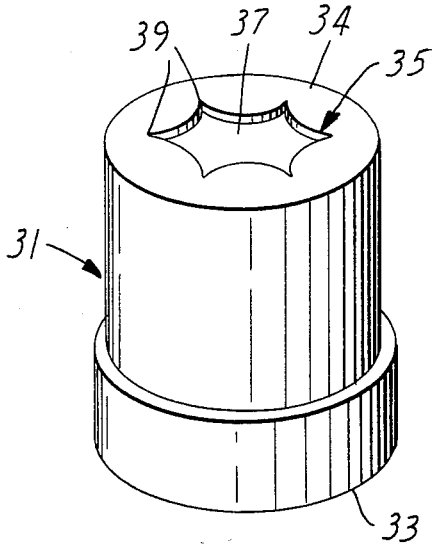
FIG. 3 is a view in perspective of one embodiment of the molded die cavities of this invention.

A molded die cavity prepared according to the present invention can be further understood by reference to FIG. 3. FIG. 3 is a perspective view of a molded die cavity 31 having a base 33 and a working surface 34. Female recess 35 lies in the end of cavity 31 opposite the base and has indented surface 37 and scallops 39. The shape of recess 35 corresponds to a male shape in the form of a fluted wheel.

Objects and advantages of this invention are illustrated in the following examples but the amounts and materials described in the examples, and various additions and details recited therein, should not be construed to limit the scope of this invention.

EXAMPLE 1

A Charpy unnotched impact bar was machined to the dimensions specified in ASTM E-23-72 (Reapproved 1978), but modified so that cross-section dimensions of 1.01±0.008 cm were used. A mold corresponding to this shape was made by surrounding the bar with "RTV-J" curable silicone rubber. The mold was cured and the bar removed from the mold. Ninety grams of tungsten powder having a mean diameter less than 15 micrometers and 210 grams of powdered $A_6$ tool steel having a mean diameter less than 44 micrometers (commercially available from Stellite Div. of Cabot Corp.) were blended in a sigma blade mixer. A 13.5 gram portion of a polymer binder ("Emerest 2642", commercially available from Emery Industries) was separately preheated to 66° C., then added to the powdered metal mixture. The powdered metals and polymer binder were hand mixed and heated to 66° C. The resulting mixture contained approximately 33 volume percent binder.

The flexible rubber mold was heated to 66° C. by storing it in a 66° C. oven for about 15 minutes. The warm powder-binder mixture was then flowed into the warm flexible mold and vibrated, using a Model J 50A "Jogger", (commercially available from Syntron Division of FMC Corp.) at a rheostat setting of 85. The mixture was deaired for 10 minutes with continued vibration in a laboratory vacuum chamber operated at 3 torr. The mold and its contents were then placed in a 66° C. oven for 1 hour, vibrated for 5 minutes at a rheostat setting of 40 and allowed to cool at room temperature (23° C.) for two hours. The mold and contents were then brought to 40° C. for 1 hour in a dessicator containing anhydrous calcium sulfate. The mold and its contents were removed from the dessicator, and the hardened, "green" molded preform then extracted from the rubber mold cavity using vacuum.

The green molded preform was placed in a graphite boat containing a supporting bed of powdered alumina ("A-100", commercially available from Alcoa, Inc.), vibrated slightly to pack the alumina powder around the green molded preform, and placed in a resistance-heated, cam-controlled box furnace (commercially available from the Lindberg Co.). The furnace was evacuated to 0.5 Torr at a sufficiently slow rate to prevent scattering of the alumina powder within the furnace. The furnace was backfilled with an atmosphere containing 95% argon and 5% hydrogen. A dynamic argon atmosphere was maintained in the furnace at a flow rate of 85 liters/hour. The furnace was heated from room temperature to 250° C. at a rate of 43° C./hour, from 250° C. to 350° C. at a rate of 7.5° C. per hour, and from 350° C. to 700° C. at 100° C./hour. The furnace was maintained at 700° C. for ½ hour, at which point the binder had completely degraded and the skeletal particles in the matrix had become tacked together.

The resulting molded skeletal preform was cooled to room temperature under the dynamic gas atmosphere of the furnace. The molded skeletal preform was removed from the alumina bed and gently brushed with a camel's hair brush to remove surface adhering alumina. An acetone dispersion of zirconia (10 g of 1 to 5 micrometer mean diameter zirconia powder in 100 ml acetone) was sprayed on all but one surface (the base) of the preform in order to prevent the infiltrant metal from overwetting the working surfaces. The base of the preform was then placed adjacent 50 g of copper powder ("R-64", commercially available from Gould, Inc.) on a bed of alumina in an open graphite crucible in a molybdenum wound electrical resistance furnace. The furnace was evacuated to 0.05 torr, backfilled with hydrogen at atmospheric pressure and maintained under a dynamic hydrogen atmosphere at a flow rate of 141 liters/hour. The furnace was heated to 1100° C. and maintained at that temperature for 15 minutes in order to carry out infiltration of the skeletal preform by copper infiltrant and volume diffusion by the second metal. The furnace was then turned off and allowed to cool normally. The exterior zirconia coating was removed from the infiltrated article by glass bead peening with less than 44 micrometer mean diameter glass beads at a pressure of 1.4 to 2.8 kg/cm$^2$.

Microscopic analysis of a metallurgically prepared sample of the infiltrated article shows that the $A_6$ tool steel surrounds the tungsten granules. The copper infiltrant had completely filled the connected porosity of the skeletal preform.

Shrinkage was measured by comparing the master shape to the final molded article. The article was tested for Rockwell C hardness and Charpy unnotched impact (simple beam, Type A) according to ASTM E-103-61 (Reapproved 1979) and ASTM E-23-72 (Reapproved 1978). The final molded article exhibited the following characteristics:

Dimensional Change: −0.4%

Rockwell hardness ($R_c$): 30

Charpy unnotched impact (CIU): 19 joules (14 ft.-lbs)

The article could be drilled with a high speed steel twist drill, yet was hard and impact resistant.

This Example shows that the articles of this invention faithfully reproduced the dimensions of the mold master and had excellent physical properties.

EXAMPLE 2

Using the method of Example 1, molded composite articles were prepared from a mixture of 70 grams tungsten powder, 930 grams powdered $A_6$ tool steel, and 57 grams polymer binder. The resulting mixture contained approximately 33 volume percent binder. The mixture was fired to form a skeletal preform as in Example 1, and infiltrated at 1050° C. with 88/12 weight % copper/tin infiltrant. The resulting infiltrated articles exhibited dimensional change of 0.1%, $R_c$ of 43, and CIU strength of 14.9 joules (11 ft.-lbs.)

EXAMPLE 3

Using the method of Example 1, molded composite articles were prepared by substituting 77/15/7 weight % copper/nickel/tin infiltrant for the infiltrant used in Example 1. The resulting infiltrated articles exhibited dimensional change of −0.44%, $R_c$ of 38, and CIU strength of 16.3 joules (12 ft.-lbs).

COMPARATIVE EXAMPLE

Using the method of Example 1, an attempt was made to prepare a molded composite article without any first metal. The powder-binder mixture was prepared from 100 g $A_6$ tool steel and 5.1 g polymer binder, and contained approximately 28 volume % polymer binder. The 28 volume % loading of polymer binder would, by itself, be expected to provide less shrinkage than would be observed if a 33 volume percent loading of polymer binder had been used. The powder-binder mixture was molded, fired, and infiltrated with copper powder as in Example 1. The resulting infiltrated article exhibited dimensional change of −1.9%, $R_c$ of 42, and CIU strength of 10.2 joules (7.5 ft.-lbs.). The high level of shrinkage and low impact strength of the final article rendered it very poorly suited for use as a molded die cavity.

This Comparative Example shows that the use of both first and second metals in the powder-binder mixture was required to preserve dimensional fidelity during manufacture of final infiltrated articles.

Various modifications and alterations of this invention will be apparent to those skilled in the art without departing from the scope and spirit of this invention and the latter should not be restricted to that set forth herein for illustrative purposes.

What is claimed is:

1. A metal composite article comprising:

(a) granules of a first metal or alloy of about 1 to about 100 micrometers mean diameter;

(b) a monolithic skeleton comprising a solid second metal or alloy having a higher Rockwell hardness than said first metal or alloy, said second metal or alloy fully enveloping the majority of said granules of first metal or alloy, the latter being uniformly dispersed in said skeleton; and (c) a continuous metallic phase occupying the connected porosity in said skeleton, said continuous phase comprising a solid third metal or alloy which wets said skeleton, has a Rockwell hardness less than or equal to the Rockwell hardness of said second metal or alloy, and has a melting point below the melting point of said second metal or alloy;

said article thereby comprising two intermeshed matrices and being substantially free of voids.

2. An article according to claim 1, wherein said first metal or alloy is less than about 15 percent of the volume of said article.

3. An article according to claim 1, wherein said first metal or alloy is about 8 to about 13 percent of the volume of said article.

4. An article according to claim 1, wherein said granules of first metal or alloy have a mean diameter of about 1 to about 44 micrometers.

5. An article according to claim 1, wherein said second metal is iron or ferroalloy.

6. An article according to claim 1, wherein said second metal or alloy is about 35 to about 70 percent of the volume of said article.

7. An article according to claim 1 wherein said second metal or alloy is about 57 to about 62 percent of the volume of said article.

8. An article according to claim 1, wherein said second metal or alloy is $A_6$ tool steel.

9. An article according to claim 1, wherein said third metal or alloy is about 15 to about 50 percent of the volume of said article.

10. An article according to claim 1, wherein said third metal or alloy is about 25 to about 35 percent of the volume of said article.

11. An article according to claim 1, wherein said third metal or alloy is copper or copper alloy.

12. An article according to claim 1, wherein said second metal is iron or ferroalloy, said third metal or alloy is copper and manganese, and there is an intermediate layer of austenitic iron at the interface between said second metal or alloy and said third metal or alloy.

13. An article according to claim 12, wherein said manganese is about 4 to about 35 percent of the weight of said third metal or alloy.

14. An article according to claim 1, further comprising at least one layer of intermediate alloy of said second metal or alloy and said third metal or an alloying metal present in said third metal or alloy, disposed between said second metal or alloy and said third metal or alloy.

15. An article according to claim 1, having a Rockwell hardness greater than about 40 and a Charpy unnotched impact strength greater than about 14 joules.

16. An article according to claim 1, having a density of at least 97 percent of the theoretical density based upon the densities of said first metal or alloy, said second metal or alloy, and said third metal or alloy.

17. An article according to claim 16, having a density of at least 99 percent of said theoretical

18. A precision molded die cavity comprising:

(a) less than about 15 volume percent granules of tungsten of about 1 to about 44 micrometers mean diameter;

(b) about 35 to about 70 volume percent of a monolithic ferroalloy skeleton, said ferroalloy fully enveloping the majority of said tungsten granules, all of the latter being uniformly dispersed in said skeleton; and (c) about 15 to about 50 volume percent of a continuous metallic phase comprising copper, said continuous metallic phase occupying the connected porosity in said skeleton:

said article thereby comprising two intermeshed matrices and being substantially free of voids.

19. A die cavity according to claim 18, wherein said tungsten is about 8 to about 13 percent of the volume of said die.

20. A die cavity according to claim 18, wherein said ferroalloy is about 57 to about 62 percent of the volume of said die.

21. A die cavity according to claim 18, wherein said copper is about 25 to about 35 percent of the volume of said die.

22. A die cavity according to claim 18, wherein said tungsten is about 8 to about 13 percent of the volume of said die, said ferroalloy is $A_6$ tool steel and is about 57 to about 62 percent of the volume of said die, and said copper is about 25 to about 35 percent of the volume of said die.

23. A die cavity according to claim 18, having a Rockwell hardness greater than about 40, a Charpy unnotched impact strength greater than about 14 joules, and a density of at least 97 percent of the theoretical density based upon the densities of said tungsten, said ferroalloy, and said copper.

24. A process for forming a precision molded composite article, comprising the steps of:

(a) blending granules of a first metal or alloy having about 1 to about 100 micrometers mean diameter with granules of a second metal or alloy having about 1 to about 100 micrometers mean diameter, said second metal or alloy having a higher Rockwell hardness than said first metal or alloy, thereby forming a uniform mixture;

(b) mixing said uniform mixture with up to 50 volume percent of a heat fugitive, organic binder;

(c) molding the resulting mixture in a heated flexible mold, cooling said mold and its contents to room temperature, and demolding said contents by applying a vacuum to the outside of said mold thereby forming an essentially void-free green molded preform having the size and shape of said mold;

(d) heating said green molded preform to thermally remove said binder and form a rigid, handleable skeletal preform;

(e) placing said skeletal preform in contact with a third metal or alloy which will wet said skeleton and which has a Rockwell hardness less than or equal to the Rockwell hardness of said second metal or alloy;

(f) infiltrating said skeletal preform with said third metal or alloy by heating said skeletal preform and said third metal or alloy above the melting point of said third metal, but below the melting point of said second metal or alloy, whereby said third metal or alloy melts and wicks into the connected porosity of said prerorm by capillary action and said second metal or alloy fully envelopes the majority of said granules of first metal or alloy, with the proviso that said granules of first metal or alloy do not completely dissolve in said second metal or alloy; and (g) cooling the infiltrated part to room temperature to form a substantially void-free precision molded article.

25. A process according to claim 24, wherein said first metal or alloy is tungsten.

26. A process according to claim 24, wherein said second metal or alloy is ferroalloy.

27. A process according to claim 24, wherein said granules of second metal or alloy have about 1 to about 44 micrometers mean diameter.

28. A process according to claim 24, wherein said third metal or alloy is copper or copper alloy.

29. A process according to claim 24, wherein said third metal or alloy comprises copper and manganese.

30. A process according to claim 24, wherein said first metal or alloy is tungsten and is less than about 15 percent of the volume of said article, said second metal or alloy is ferroalloy and is about 35 to about 70 percent of the volume of said article, said third metal or alloy is copper and is about 15 to about 50 percent of the volume of said article, and said molded article is a die cavity.

31. A process according to claim 24, wherein the change in any lineal dimension between the dimensions of said void-free green molded preform and the dimensions of said void-free precision article is less than about 1 percent.

32. A process according to claim 31, wherein said change in any lineal dimension is less than about 0.5 percent.

33. A process according to claim 31, wherein said article has a density at least 97 percent of the theoretical density of said article.

34. A process according to claim 31, wherein said article has a density at least 99 percent of the theoretical density of said article.

* * * * *

UNITED STATES PATENT AND TRADEMARK OFFICE

CERTIFICATE OF CORRECTION

PATENT NO. : 4,554,218

DATED : November 19, 1985

INVENTOR(S) : Richard N. Gardner and Kenneth R. Dillon

It is certified that error appears in the above-identified patent and that said Letters Patent is hereby corrected as shown below:

On the cover page, "INFILTRATED POWERED METAL COMPOSITE ARTICLE" should read --INFILTRATED POWDERED METAL COMPOSITE ARTICLE --.

Col. 1, title (page 1, line 1), "INFILTRATED POWERED METAL COMPOSITE ARTICLE" should read --INFILTRATED POWDERED METAL COMPOSITE ARTICLE --.

Col. 18, line 31 (page 33, lines 10-11), "theoretical" should read -- theoretical density. --.

Col. 20, line 11 (page 35, line 27), "alloy" should read -- alloy --.

Signed and Sealed this

*Fifth* Day of *August 1986*

[SEAL]

*Attest:*

DONALD J. QUIGG

*Attesting Officer*

*Commissioner of Patents and Trademarks*